US010329057B2

(12) United States Patent
Khalaf

(10) Patent No.: US 10,329,057 B2
(45) Date of Patent: Jun. 25, 2019

(54) SPILL RESISTANT CUP LID

(71) Applicant: Oculus Design LLC, Dover, DE (US)

(72) Inventor: Tariq Ziad Khalaf, Bethesda, MD (US)

(73) Assignee: OCULUS DESIGN LLC, Dover, DE (US)

( * ) Notice: Subject to any disclaimer, the term of this patent is extended or adjusted under 35 U.S.C. 154(b) by 318 days.

(21) Appl. No.: 15/212,773

(22) Filed: Jul. 18, 2016

(65) Prior Publication Data

US 2017/0127860 A1 May 11, 2017

Related U.S. Application Data

(60) Provisional application No. 62/253,892, filed on Nov. 11, 2015.

(51) Int. Cl.
*B65D 43/02* (2006.01)

(52) U.S. Cl.
CPC ..... *B65D 43/0212* (2013.01); *B65D 2543/00027* (2013.01); *B65D 2543/00046* (2013.01); *B65D 2543/00092* (2013.01); *B65D 2543/00296* (2013.01); *B65D 2543/00527* (2013.01); *B65D 2543/00537* (2013.01); *B65D 2543/00638* (2013.01); *B65D 2543/00685* (2013.01); *B65D 2543/00759* (2013.01); *B65D 2543/00796* (2013.01)

(58) Field of Classification Search
CPC ..... B65D 43/0212; B65D 43/0222; B65D 2543/00805
USPC ..... 220/713, 711, 400, 404
See application file for complete search history.

(56) References Cited

U.S. PATENT DOCUMENTS

| | | | |
|---|---|---|---|
| 4,319,692 | A | 3/1982 | Gundlach |
| 4,589,569 | A | 5/1986 | Clements |
| 4,619,372 | A | 10/1986 | McFarland |
| 4,767,019 | A | 8/1988 | Horner |
| D402,556 | S | 12/1998 | Frye |
| 6,176,390 | B1 | 1/2001 | Kemp |
| 6,431,390 | B1 | 8/2002 | Waller |
| 6,533,139 | B2 | 3/2003 | Lukacevic |
| D485,759 | S | 1/2004 | Janky et al. |
| 6,905,044 | B1 | 6/2005 | Russo et al. |
| 6,991,128 | B1 | 1/2006 | Russo et al. |
| 7,064,224 | B1 | 6/2006 | Lei et al. |
| D695,612 | S | 12/2013 | Chou |
| D704,054 | S | 5/2014 | Fleming |
| D704,055 | S | 5/2014 | Fleming |

(Continued)

OTHER PUBLICATIONS

U.S. Office Action dated Aug. 10, 2016, directed to related U.S. Appl. No. 29/568,662 (8 pages).

*Primary Examiner* — Anthony D Stashick
*Assistant Examiner* — Raven Collins
(74) *Attorney, Agent, or Firm* — DLA Piper LLC (US)

(57) ABSTRACT

Disclosed is a lid for containers including one or more liquids. The lid is configured to provide the user with both protection from spillage, and a natural drinking experience. The structural features of the lid include a rim, a top surface, and a reservoir. The reservoir includes one or more drink inlets positioned on a lower wall portion configured to allow the one or more liquids from the container to pass through when the lid is in a drinking position, and to drain the one or more liquids from the lid to the container when the lid is not in a drinking position.

27 Claims, 7 Drawing Sheets

(56) References Cited

U.S. PATENT DOCUMENTS

| | | | | |
|---|---|---|---|---|
| D709,366 | S | 7/2014 | Fleming | |
| D722,498 | S | 2/2015 | Fleming | |
| D722,873 | S | 2/2015 | Wu | |
| 8,950,623 | B2 | 2/2015 | Fleming | |
| D752,436 | S * | 3/2016 | Crudgington | D9/434 |
| 2004/0118847 | A1* | 6/2004 | Giraud | B65D 43/0208 220/254.3 |
| 2005/0173443 | A1* | 8/2005 | Crudgington, Jr. | B65D 47/40 220/713 |
| 2008/0041862 | A1 | 2/2008 | Bal | |
| 2008/0245792 | A1 | 10/2008 | Chou | |
| 2009/0294460 | A1* | 12/2009 | Hovsepian | B65D 43/0212 220/713 |
| 2010/0133272 | A1 | 6/2010 | Whitaker et al. | |
| 2014/0042177 | A1* | 2/2014 | Fleming | B65D 43/02 220/713 |
| 2014/0042178 | A1 | 2/2014 | Brannock | |
| 2014/0319138 | A1 | 10/2014 | Polt | |
| 2015/0136771 | A1* | 5/2015 | Eyal | B65D 43/0202 220/254.1 |
| 2015/0191282 | A1 | 7/2015 | Crudgington | |
| 2015/0251818 | A1 | 9/2015 | Strachan et al. | |
| 2016/0045045 | A1* | 2/2016 | Mazzarolo | B65D 43/24 220/254.3 |

* cited by examiner

SPILL RESISTANT CUP LID

CROSS REFERENCE TO RELATED APPLICATIONS

This application claims priority to U.S. Provisional Patent Application No. 62/253,892, filed Nov. 11, 2015, the entire contents of which are incorporated by reference, as if fully set forth herein.

FIELD OF THE INVENTION

The present invention generally relates to beverage containers, and more specifically, to lids for beverage containers.

BACKGROUND OF THE INVENTION

Disposable beverage lids are commonly used to cover beverage cups, and in particular, beverage cups containing hot liquids. Disposable beverage lids are configured to prevent spillage of the liquids contained in the beverage cups while consumers are on the move. The disposable beverage lids perform two central functions. The first function is to protect the user from the spillage of the beverage. The second function is to allow the user to drink in a natural drinking experience, similar to what a user would experience when drinking out of a regular beverage container such as a water glass or coffee mug. The above two functions must be available to users both when they are stationary and on the move.

In order to perform the two central functions discussed above, the disposable beverage lid must both contain the liquid in the container and also provide for easy and comfortable drinking. Although the prior art systems have addressed one of two central functions individually, none have successfully addressed the two central functions in unison.

A common solution in the prior art utilizes spout-based designs that are characterized by a generally horizontal and small drink inlet from which the user receives the beverage. Often the spout-based designs fail to address the first function of disposable beverage lids, protecting the user from the spillage of the beverage. In particular, the spout-based designs fail to significantly inhibit accidental splashing of the beverage. In fact, in spout-based designs the horizontal drink inlet is configured to maximize the direct vertical path of liquid out of the containment, when the container and lid are in use. To prevent accidental splashing of the beverage, the industry's most common solution has been to add a secondary piece to the lid to act as a manual closing flap or plug. Such solutions generally add a significant cost to the manufacturing process and make for an interrupted drinking experience as the user is required to consistently open and close the flap while in use.

The spout-based designs often also fail to address the second function, in that the spout-based designs are unable to provide a natural drinking experience, as the user's drinking experience resembles a child's pacifier in that the user fully covers the drink inlet or spout with their mouth while in use and the user employs suction to extract the beverage. This is significantly different than the natural drinking experience where a larger body of liquid is readily exposed for the user's consumption.

Prior art such as U.S. Pat. No. 6,991,128 (hereinafter "Russo") provides a spout-based design and attempts to minimize the accidental splashing of liquid through the spout by the reduction and reorientation of the drink inlets. While this may help reduce the spillage, it does so at the expense of providing the flow of liquid necessary for a comfortable drinking experience. As such, Russo provides a solution for one necessary function of the lid, in this case splash resistance, while neglecting the other necessary function of the lid, providing a natural drinking experience.

As a solution to the undesirable drinking experience provided by spout-based designs some prior art solutions have utilized well or reservoir based designs that provide a natural drinking experience by exposing a larger volume of liquid to the surface as the lid is tilted for use. This approach makes for a generally more familiar and comfortable drinking experience, similar to drinking out of a regular mug. In one example, U.S. Pat. App. 2014/0042177 (hereinafter "Fleming") attempts to provide a natural drinking experience. However, like other prior art references, Fleming does not do not fully solve the issue of splashing. In fact, spout-based designs that utilize wells and/or reservoirs often provide larger drink openings that may increase the risk of splashing when the liquid is suddenly jolted in the cup. In such designs, the drink inlet is oriented to face the major axis the liquid waves along in the cup and so that the lid is more prone to spillage. As such, Fleming provides a solution for one necessary function of the lid, in this case a natural drinking experience, while neglecting the other necessary function of the lid, providing splash resistance.

The Russo and Fleming references noted above exemplify other prior art references that provide one of the two desirable functions of beverage lids (i.e., protecting the user from spillage of the beverage, and allowing the user to drink in a natural drinking experience), however, no prior art references provide both desirable functions of beverage lids.

Accordingly, there is a need for a beverage lid that provides the user with both protection from the spillage of the liquid, and a natural drinking experience.

The present invention aims to solve several of the problems necessarily associated with the spout-based and reservoir designs of Russo and Fleming. For one, the present invention provides a user with both protection from spillage of the liquid, and a natural drinking experience.

SUMMARY OF THE INVENTION

An exemplary embodiment of the present invention comprises a lid for covering a container containing one or more liquids, the lid including a top surface and a reservoir formed below the top surface, the reservoir comprising an upper wall portion extending from the top surface to an upper level, wherein the upper wall portion is slanted radially inwards, wherein the upper level is configured to retain the one or more liquids within the container, a lower wall portion extending from the upper level to a lower level, wherein the lower wall portion is slanted radially inwards, and wherein the lower wall portion further comprises one or more inlets, each of the one or more inlets being configured to allow the one or more liquids from the container to pass therethrough when the container is in a drinking position, wherein in the drinking position the one or more liquids in the container pass through the one or more inlets to fill at least a portion of the reservoir, and wherein at least one of the upper wall portion, the lower wall portion, the upper level, and the lower level are configured to drain the one or more liquids from the reservoir when the container is not in a drinking position, by allowing the one or more liquids to flow towards the container through the one or more inlets.

BRIEF DESCRIPTION OF THE DRAWINGS

The invention will be better understood with reference to the following detailed description, of which the following drawings form an integral part.

DETAILED DESCRIPTION OF THE INVENTION

Figure 1:
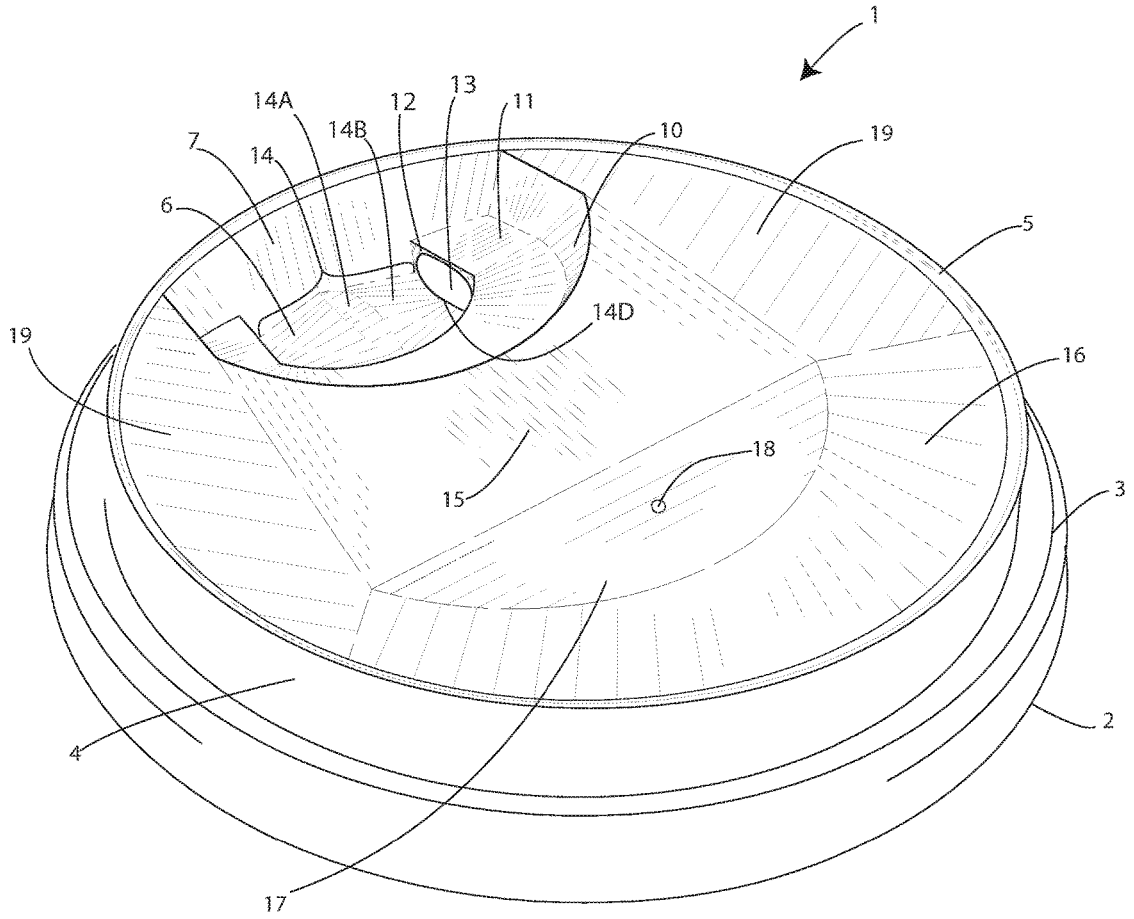
FIG. 1 is a top perspective view of a lid according to a first exemplary embodiment of the present invention.

The present invention relates to a lid. In one embodiment, the lid is configured to cover a container holding one or more liquids. The one or more liquids may be hot or cold. In one embodiment, the lid provides the user with both protection from the spillage of the beverage and a natural drinking experience. In one embodiment, the lid is an inexpensive one-piece design manufactured through a one-step vacuum formed process or the like. The lid may be non-disposable or disposable.

The lid may include a rim, a top surface and a reservoir. In one embodiment, the lid may be generally circular. The rim may be located around the periphery of the lid and may be configured to engage with a cup or container holding one or more liquids. In particular, the rim may include an annular first wall and an annular second wall such that an upper edge of the cup or container may be engaged between the first wall and the second wall of the rim. The top surface of the lid may include one or more air inlets configured to allow air flow and one or more indented regions configured to receive one or more body parts of the user. For example, one or more indented regions may be configured to receive a user's nose when the user drinks from the lid and container. The top surface may be recessed.

The reservoir of the lid may include an upper wall portion, an upper level, a lower wall portion and a lower level. The upper wall portion may extend from the top surface of the lid to the upper level of the lid. The upper wall portion may be slanted radially inwards. The upper level of the lid may be configured to retain the one or more liquids for drinking. The lower wall portion may extend from the upper level to the lower level and may also be slanted radially inwards. The lower wall portion may also include one or more inlets, each of the inlets being configured to allow the one or more liquids from the container pass through the inlet when the lid is in a drinking position. At least a portion of the lower level may be positioned below the upper edge of the container. As used in this disclosure "slanted radially inwards" indicates the direction towards the center of the reservoir.

The lid provides a natural drinking experience to the user by way of the reservoir. In particular, the reservoir is configured to fill with a volume of liquid when the container and lid are tilted for use. The liquid enters the reservoir through one or more almost vertically oriented drink inlets that are placed in the lower portions of the reservoir. In one embodiment, the lid includes two vertically oriented drink inlets. When the container and lid are tilted, the reservoir is filled from the lower level to the uppermost level. When the reservoir is fully filled with the one or more liquids a user may then take a sip from a large and exposed body of liquid, similar to what one would do when drinking from a regular coffee mug. After a user takes a sip, the structure of the reservoir is configured to drain the one or more liquids from the reservoir back into the container through the one or more drink inlets.

In addition to providing a natural drinking experience, the lid also significantly inhibits accidental splashing without the use of additional manual flaps or plugs. In particular, vertically orienting the drink inlets and placing them at a parallel axis to the centerline of the lid, helps minimize the possibility of the one or more liquids escaping the lid due to sudden movements. The drink inlets may be strategically positioned such that in the event(s) of forward waving of the liquid and/or rotational sloshing of the liquid contact between the one or more drink inlets and the one or more liquids is minimized. Additionally, the drink inlets may be placed at the lower portion of the reservoir which allows the upper structure of the reservoir to catch and drain any liquid that managed to seep through the inlets at an angle. Accordingly, the lid is able to significantly inhibit splashing while still remaining readily open for the user and providing an natural drinking experience.

The lid is able, by way of the reservoir and one or more drink inlets, to successfully provide a user with both a natural drinking experience and significant splash resistance. Providing a natural drinking experience is often found to be inversely correlated with providing splash resistance. For example, if the size of the one or more drink inlets is increased the overall splash resistance may be reduced.

Accordingly, the present embodiment balances the need for a natural drinking experience with the need for splash resistance by way of the reservoir and orientation of the drink inlets. In particular, the lid provides the user with a natural drinking experience by having a reservoir which provides a minimum volume of liquid for the user, has an initial uppermost opening large enough to accommodate the average human mouth (similar to the rim of a regular mug), and provides the necessary flow of one or more liquids as the reservoir is filled so that the user receives the one or more liquids immediately.

In one embodiment, the configuration of the reservoir includes multiple levels. The upper level of the reservoir may be configured to be wider than the lower level of the reservoir so as to accommodate the average human mouth and provide a larger volume for the one or more liquids. The lower level of the reservoir may be configured to be narrower than the upper level so that the one or more drink inlets are located close to each other so as to provide improved flow of the one or more liquids into the reservoir.

In one embodiment, the one or more drink inlets may be arranged around the centerline of the lid. The peak of the one or more liquids generally falls at the centerline of rotation when the container and lid are tilted for use. The centerline of rotation may align with the centerline of the container. The farther apart the one or more drink inlets are spaced the more tilt the user must exude in order to fill the reservoir. When the drink inlets are spaced closer together less tilt and time is required to submerge the drink inlets in the liquid and to fill the reservoir. The shape and size of the drink inlet may also be adjusted to insure steady flow of the reservoir.

In one embodiment, the top surface of the lid may include one or more sloped surfaces or indentations configured to receive one or more body parts of the user. For example, the surface of the lid may include sloped surfaces that recede to a low horizontal surface meant to accommodate the user's nose while in use. In one embodiment, the top surface may also include one or more inlets configured to allow air to pass through. The one or more inlets configured to allow air to pass through may assist in alleviating the pressure in the container, and distributing any smells associated with the liquid in the container.

FIG. 1 is a top perspective view of a lid according to a first exemplary embodiment of the present invention. As depicted, the lid 1 may be circular. Alternatively, the lid may be any other shape suitable for covering an opening of a container configured to hold one or more liquids. The lid 1 comprises a generally circular base 2 and rim 3 located about the periphery of the circular base 2 and configured to snap onto a container 50 (shown in FIG. 3). The lid 1 may include a rim 3, a top surface 15, and a reservoir 6.

The rim 3 may include a first wall and a second wall and may be configured to engage the upper edge p6 of a container 50 (shown in FIG. 3) between the first wall and the second wall. The rim 3 may be configured to snap on to the container 50. The lid 1 may further include an annular side wall 4 configured to connect to a raised peripheral lip 5 of the lid 1. The annular side wall 4 may be configured to act as a continuous border around an upper portion of the lid 1. The annular side wall 4 may provide a resting place for a user's lower lip when the user drinks from the lid and container. In one embodiment the annular side wall may have a height of approximately 4 to 12 mm, and optimally about 8.5 mm. The peripheral lip 5 may form a 2 mm border around the upper portion of the lid 1.

Alternatively, an embodiment of the lid may omit the annular side wall. In such an embodiment, the rim may be structurally the same as the raised peripheral lip and the hollow lip may also be omitted. In this embodiment, the upper portion of the reservoir may also extend below the upper edge of the container.

The top surface 15 of the lid 1 includes one or more surfaces 16, 17 and 19. The one or more surfaces 16, 17, and 19 may have varying slopes. As depicted in FIG. 1, a first top surface 15 adjacent to the reservoir 6 may slope generally downwardly towards a recessed (or indented) horizontal surface 17 located proximate to the center of the lid 1. The first top surface 15 may be sloped at angle between approximately five degrees (5°) and twenty-five degrees (25°), and may preferably be sloped at about ten degrees (10°). The recessed horizontal surface 17 may be configured to receive one or more body parts of the user. For example, the recessed horizontal surface 17 may be configured to accommodate the user's nose when the lid 1 is in use. The recessed horizontal surface 17 may be sloped at an angle between approximately zero degrees (0°) (a flat surface) to ten degrees (10°). A second top surface 16 located opposite the reservoir 6 may also be generally slanted towards the recessed horizontal surface 17. In one embodiment the second top surface 16 may be sloped at an angle between approximately ten degrees (10°) and twenty-five degrees (25°). Top surfaces 19 located along the sides of the lid 1 may also be generally slanted towards the first top surface 15 and/or the reservoir 6 and/or the second top surface 16. The top surfaces 19 may be comprised of sub-regions having varied slope. The slope of each of the sub-regions may range from between approximately five degrees (5°) to twenty degrees (20°).

The top surface 15 of the lid 1 may include one or more air inlets 18 configured to allow air flow. Alternatively, one or more air inlets may be located on any of the surfaces 15, 16, 17, and 19. The exemplary embodiment depicted in FIG. 1 includes a small air inlet 18 of a diameter less than 1 mm. The air inlet 18 is a simple opening in the surface of the lid 1 that may be manufactured through stamping or other conventional cutting methods. In other embodiments, the air inlet may be multiplied and/or relocated to other areas of the top surface 15 of the lid 1. Various shapes and sizes of the air inlet 18 are also envisioned as being within the scope of the present invention.

The reservoir 6 may include two wall portions (an upper wall portion and a lower wall portion), and a upper level. The lower level may be of a shape corresponding to the interior of the upper level. As depicted, the reservoir 6 may include an upper wall portion 10 extending from the top surface 15 (including top surfaces 19) to an upper level 11. The upper wall portion 10 may be slanted radially inwards at an angle between about fifty-five degrees (55°) to eighty-five degrees (85°). The upper level 11 may be configured to retain one or more liquids for drinking by the user. A lower wall portion 12 may extend from the upper level 11 to a lower level 14. The lower wall portion 12 may be slanted radially inwards at an angle between about seventy degrees (70°) to ninety degrees (90°). The angles of the upper wall portion 10 and the lower wall portion 12 may be adjusted in accordance with the desired splash protection. For example, in one embodiment, having a lower wall portion 12 slanted radially inwards at an angle of about ninety degrees (90°) may provide the greatest possible splash resistance. The lower wall portion 12 may also include one or more inlets 13. Each of the inlets 13 may be configured to allow one or more liquids from the container 50 to fill the reservoir 6 when the lid 1 is in a drinking position, and drain from the reservoir 6 to the container 50 when the lid 1 is in a non-drinking position. The lower level 14 may be convex with a raised central base 14A, and one or more surrounding areas 14B. Each of the surrounding areas 14B may slant towards a respective one of the one or more inlets 13. The surrounding areas 14B may slant at an angle of at least five degrees (5°). The intersection of the surrounding areas 14B and the lower wall portion 12 may form the lowest portion 14D of the reservoir 6. The lowest portion 14D of the reservoir 6 may be configured to be positioned about 3 mm to 15 mm, and preferably approximately 8 mm below the upper edge p6 of the container 50. The reservoir 6 may also include a back wall 7 which extends from the lip 5 of the lid 1 to the lower level 14, and to the ends of the upper level 11, the upper wall portion 10 and the lower wall portion 12. The back wall 7 may be slanted at an angle 'g' with respect to the horizontal planes p1, p2, p3, and p4 (illustrated in FIGS. 4 and 8). For example, the back wall 7 may be slanted at an angle 'g' between about fifty degrees (50°) to ninety degrees (90°), and preferably about 75 degrees (75°).

In an exemplary embodiment of the invention, the reservoir 6 may be substantially u-shaped. In such an embodiment, the upper wall portion 10, the upper level 11 and the lower wall portion 12 may also be substantially u-shaped and symmetrical about centerline c1. The lower level 14 may shaped to fill the interior of the substantially u-shape. In an alternative embodiment, the reservoir 6 may be substantially rectangular in shape. Although u-shaped and rectangular shaped reservoirs are discussed, any suitable shape may be used for the reservoir 6.

In an exemplary embodiment of the invention, each of the upper wall portion 10 and lower wall portion 12 may include sub-portions. Each of the sub-portions of the upper wall portion 10 and/or lower wall portion 12 may have varied angles at which they slant radially inwards. In one embodiment, the upper wall and/or the lower wall may be discontinuous. In one embodiment where the upper wall and/or the lower wall are discontinuous the sub-portions of the upper wall and/or lower wall may be separated by at least a portion of the lower level 14 and/or the upper level 11.

Figure 2:
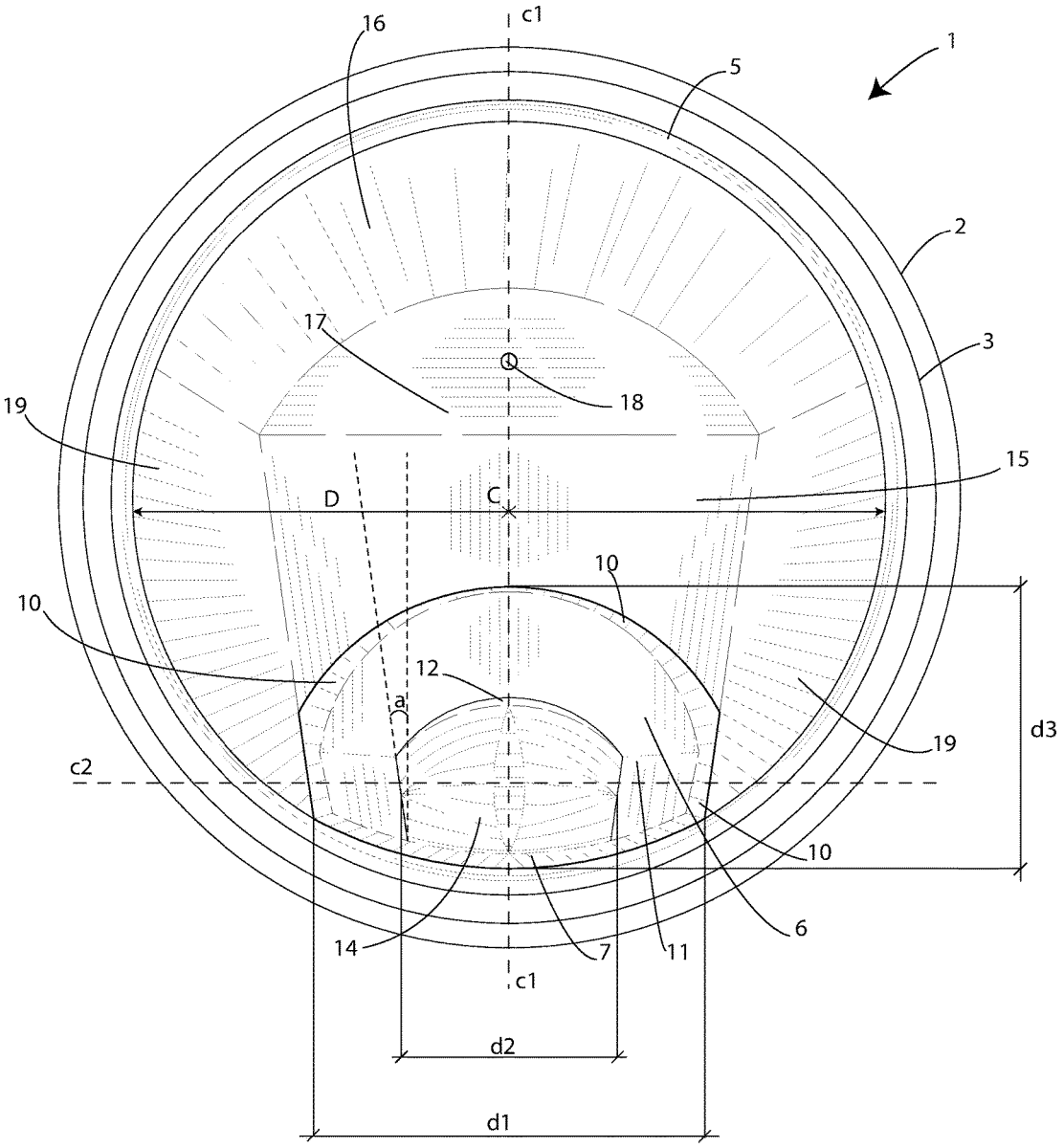
FIG. 2 is a is a top view of the lid shown in FIG. 1.

FIG. 2 is a top view of a lid according to a first exemplary embodiment of the present invention. As depicted in FIG. 2, the reservoir 6 and the one or more air inlets 18 may be located along a centerline 'c1' of the lid 1. The one or more inlets 13 may be located along a line c2, which runs perpendicular to the centerline c1. The lid 1 may be symmetrical about the centerline c1 of the lid 1. The raised peripheral lip 5 of the lid 1 may have a diameter 'D' which may be in the range of about 50-100 mm, but preferably 80 mm. The reservoir 6 may have an initial opening width 'd1' in the range of about 30-55 mm, but preferably 40 mm. The width of the initial opening d1 may be proportional to the total diameter D. For example, the width of the initial opening d1 may be about fifty percent (50%) of the total diameter D. In one embodiment, the width of the initial opening d1 may be about fifty-two and six tenths percent (52.6%) of the total diameter D. In other embodiments the width of the initial opening d1 may fall within about forty percent (40%) to seventy percent (70%) of the diameter D. The width of the initial opening d1 may be configured to be any suitable width so as to accommodate a human mouth. The lower level 14 of the reservoir 6 may have a width 'd2' in the range of about 5 mm to 30 mm. The width 'd2' may be proportional to the total diameter 'D'. For example the width 'd2' may be in the range of about five percent (5%) to forty percent (40%) of the total diameter 'D'. The reservoir 6 may have length 'd3' in the range of about 10 mm to 50 mm. The length 'd3' of the reservoir 6 may be proportional to the total diameter 'D'. For example, in one embodiment, the length 'd3' may be in the range of between twelve and a half percent (12.5%) to seventy-five percent (75%) of the total diameter 'D'. Preferably, the length 'd3' may be about thirty-one percent (31%) of the diameter 'D' or approximately 25 mm in the embodiment illustrated in FIG. 2. The length d3 may be configured to accommodate the user's upper lip when the lid 1 is in use.

The lower wall portion 12 may include one or more drink inlets 13. Each of the one or more drink inlets 13 may form an angle 'a' with respect to the centerline c1. The angle 'a' may be in the range of approximately zero degrees (0°) to fifteen degrees (15°), and preferably about seven degrees (7°). In one embodiment, the deviation of the one or more drink inlets 13 from the centerline c1 at an angle 'a' assists in draining the one or more liquids from the reservoir to the container while maintaining the necessary splash resistance.

Figure 3:
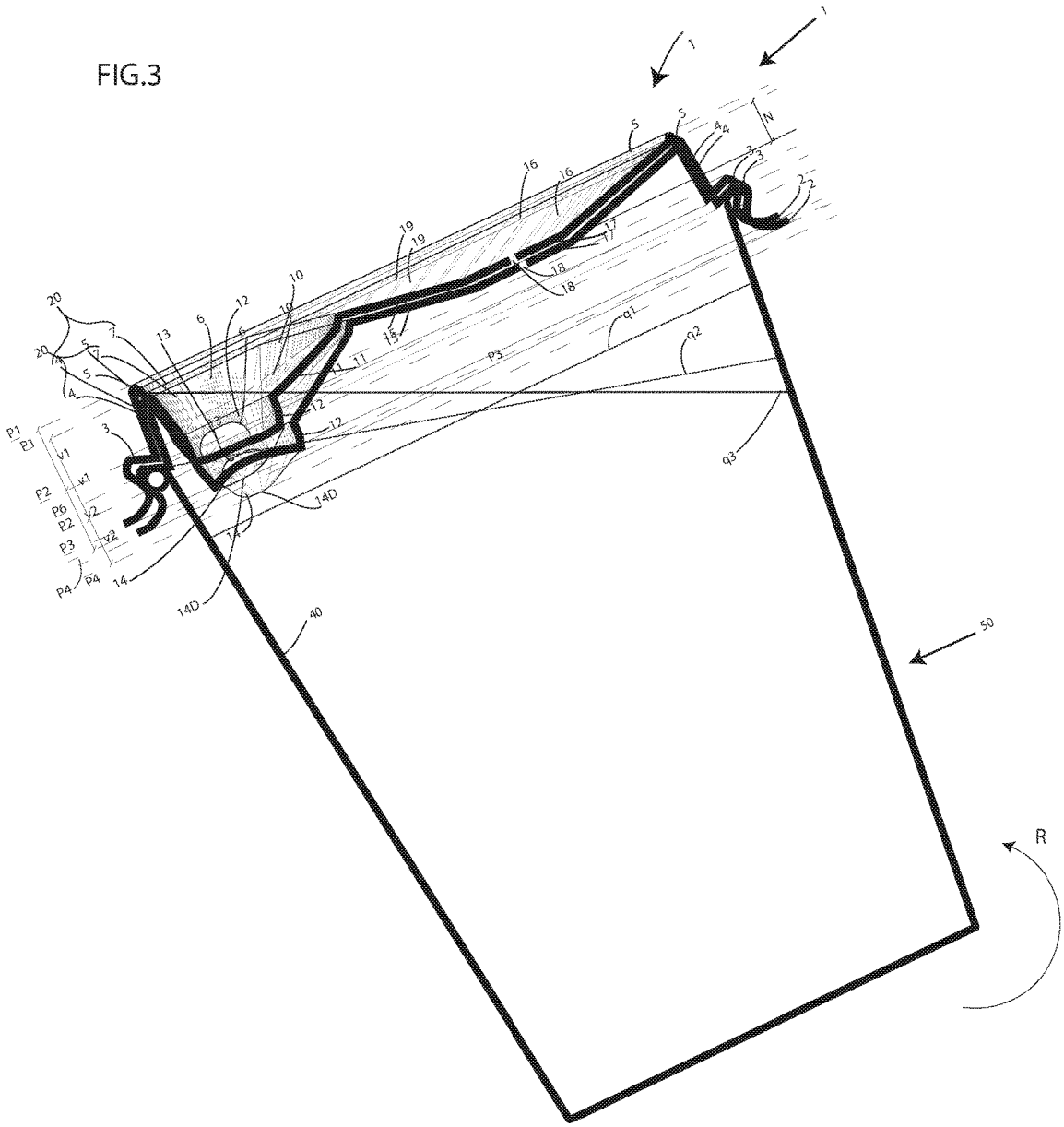
FIG. 3 is a side view of a lid shown in FIG. 1 placed on a container according to a first exemplary embodiment of the present invention.

FIG. 3 is a side view of a lid 1 and container 50 according to a first exemplary embodiment of the present invention. In FIG. 3 the lid 1 is engaged with the container 50 by way of the rim engaging an upper edge p6 of the container 50 between a first wall and a second wall of the rim 3. As depicted in FIG. 3, the lid 1 may be defined by four planes: a first plane p1 extending parallel to top surface 15 of the lid 1 tangentially to the uppermost point of lip 5, a second plane p2 parallel to the first plane p1 and extending along the surface formed by the upper level 11 of the reservoir 6 at the intersection of the upper level 11 and the lower wall portion 12, a third plane p3 parallel to both the first plane p1 and the second plane p2 and extending along the surface formed by the lower edge of the circular base 2, and a fourth plane p4 parallel to the first plane p1, second plane p2, and third plane p3 and extending along the surface formed by the lowest portion 14D of the reservoir 6. The reservoir 6 may include a first volume portion v1 spanning from the first plane p1 to the second plane p2 and bounded by at least a portion of the back wall 7, the upper level 11, and the upper wall portion 10. The reservoir 6 may also include a second volume portion v2 spanning from the second plane p2 to the fourth plane p4 and bounded by at least a portion of the back wall 7, the lower wall portion 12, and the lower level 14 (including the raised central base 14A, the one or more surrounding areas 14B, and the lowest portion 14D of the reservoir 6).

The container 50 engaged with the lid 1 may be rotated in a direction a' from a substantially vertical position (i.e., a non-drinking position) to a substantially diagonal position (i.e., a drinking position). The container 50 may include inner walls 40. When the container 50 and lid 1 are in a substantially vertical (non-drinking) position the liquid surface of the one or more liquids contained within the container 50 may be at a first line q1. As the container 50 engaged with the lid 1 is tilted (or rotated) as indicated by direction R, the distance between the lower level 14 of the reservoir 6 and the liquid surface q1, q2 continuously decreases until the liquid surface rises above the bottom edge of the one or more drink inlets 13 in order to fill the reservoir 6 with the one or more liquids. The second line q2 indicates the level of liquid midway through a full tilt as the lower portion v2 of the reservoir 6 is being filled. As the user continues the rotation in direction R the liquid level incrementally climbs the back wall 7 until it reaches the lip 5 and is ready for consumption, as is indicated by liquid level q3.

Figure 4:
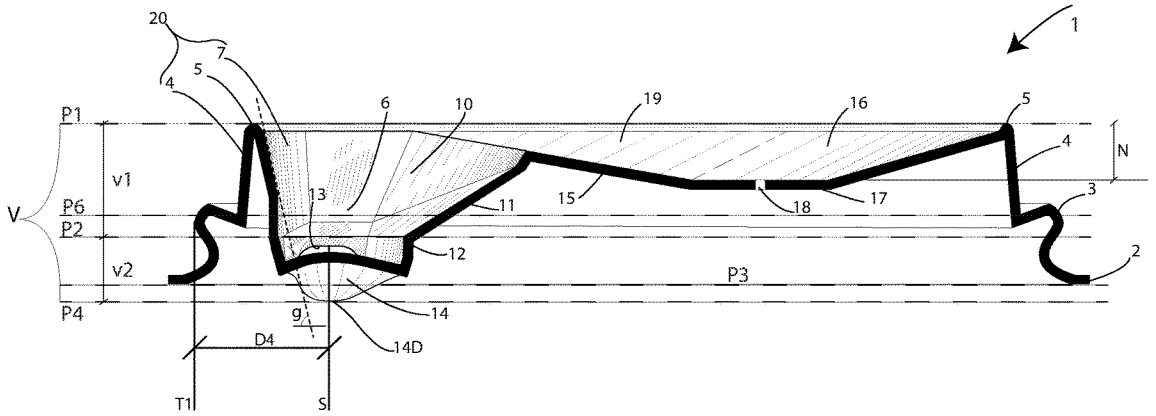
FIG. 4 is a cross-sectional side view of the lid shown in FIG. 1, taken along line c1 in FIG. 2.

FIG. 4 is a side cross-sectional view of a lid according to a first exemplary embodiment of the present invention. The cross-section is taken along centerline c1 in FIG. 2. As depicted, the reservoir 6 may have a uppermost opening defined at one end by a hollow lip 20 that is comprised of the peripheral lip 5 at the top, and two receding walls 4 and 7 at opposing ends thereof. The uppermost opening may also be defined by the intersection between surfaces 15, 19 and the upper wall portion 10. The hollow lip 20 may be where the user engages with the lid 1 to receive the beverage. The outer wall 4 of the hollow lip 20 may be where the user's lower lip rests while the user's upper lip may submerge in the volume contained by the reservoir 6 in order to retrieve the beverage when the container 50 and lid 1 are tilted in a direction R for use. In this manner, the user may have a natural drinking experience. As shown, the one or more drink inlets 13 may comprise two (2) drink inlets positioned symmetrically about the centerline c1. The center of each of the two drink inlets 13 may be located along line 'S' at a distance d4 from a tangent line T1 which marks the outermost edge of the rim 3. As illustrated in FIG. 4, the centermost point of each of the drink inlets 13 may align with the apex of the raised central base 14A. The alignment of the apex of the raised central base 14A with the centermost point of each of the drink inlets 13 may be advantageous in that it allows for improved movement of liquid from one of the two inlets to the other of the two inlets, thereby reducing splashing due to rotational waving. FIG. 4 also depicts a recess distance N corresponding to the distance between the recessed horizontal surface 17 and the first plane p1. In one exemplary embodiment, the recessed horizontal surface 17 may be set 5 mm below the first plane p1 (making the recess distance N equal to 5 mm). However, in other exemplary embodiments, the recess distance N may be in the range of 0-15 mm (below the first plane p1). FIG. 4 also shows an angle 'g' corresponding to the angle the back wall 7 recedes from the peripheral lip 5 towards the lower level 14.

Figure 5:
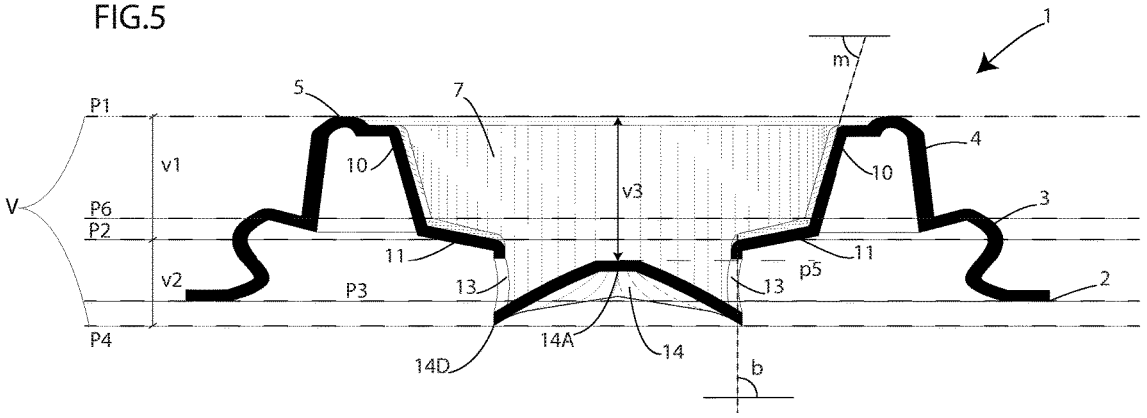
FIG. 5 is a cross-sectional side view of the lid shown in FIG. 1, taken along line c2 in FIG. 2.

FIG. 5 is a side cross-sectional view of a lid according to a first exemplary embodiment of the present invention. The cross-section is taken along line c2 in FIG. 2. As depicted, the lower wall 12 may be slanted radially inwards at an angle 'b' and the upper wall 10 may be slanted radially inwards at an angle 'm.' Additionally, a vertical distance v3 may be defined from the first plane p1 to a fifth plane p5. The fifth plane p5 may be substantially parallel to the first, second, third and fourth planes p1, p2, p3, and p4 and extend along the surface formed by the raised central base 14A of the reservoir 6.

Figure 6A:
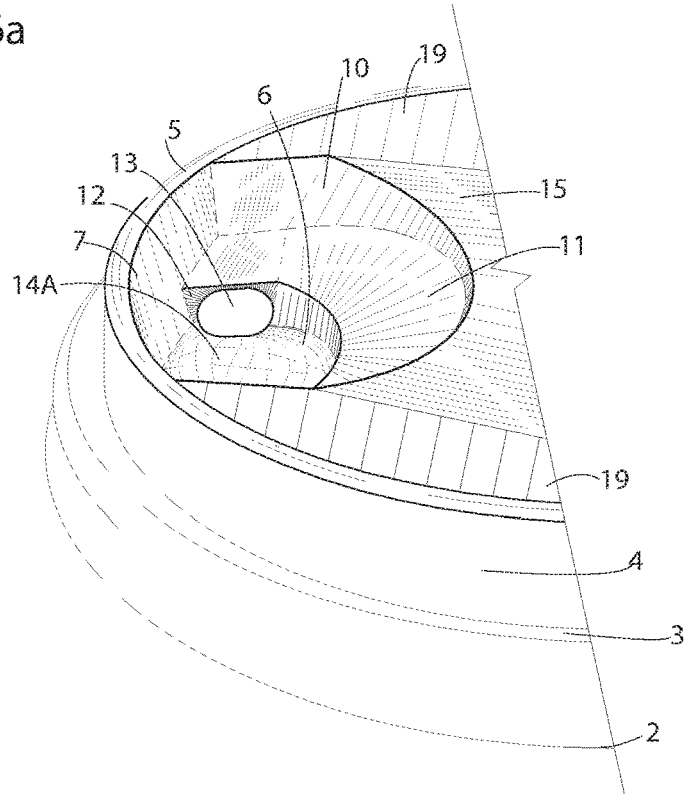
FIG. 6A is a top perspective view, partially cut away, of the lid shown in FIG. 1.

FIG. 6A is a top perspective view, partially cut away, of a portion of a lid according to a first exemplary embodiment of the present invention. As depicted, the lower wall portion 12 of the reservoir 6 may include one or more inlets 13. The one or more inlets 13 may be located on one or more axes parallel to the direction of tilting in the drinking position. In one exemplary embodiment of the present invention, two such inlets 13 may be positioned along the lower wall portion 12 on opposing sides of, and equidistant from, the centerline c1. Only one of the drink inlets 13 is visible in the top perspective view of FIG. 6A. As one skilled in the art would recognize, the other drink inlet 13 comprises a mirror image of the depicted drink inlet. The drink inlets 13 may be elliptical in shape, and may be located at the lowest portion 14D of the reservoir 6. The lower side of the drink inlets 13 may be adjacent to the portion point 14D of the reservoir.

Figure 6B:
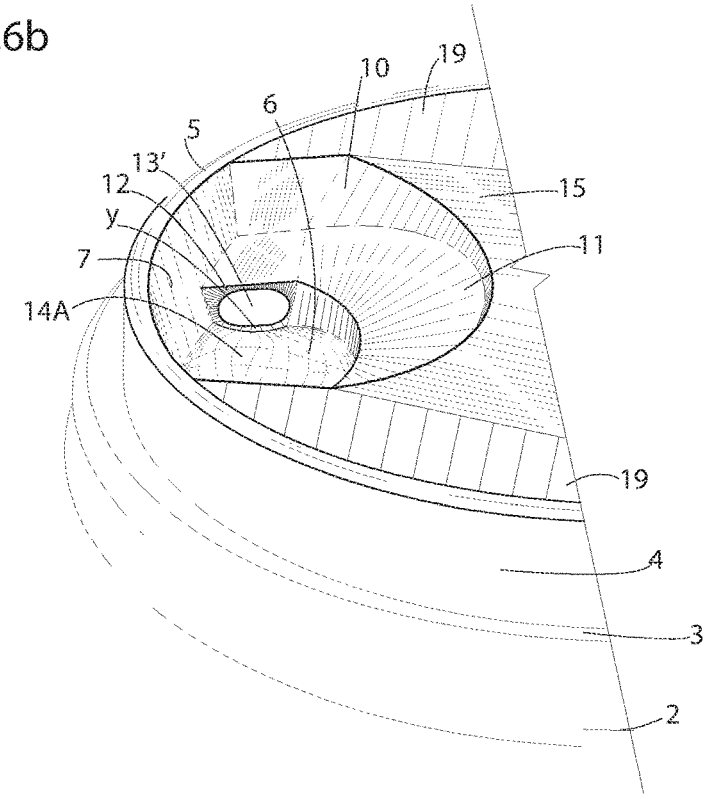
FIG. 6B is a top perspective view, partially cut away, of a lid according to a second exemplary embodiment of the present invention.

FIG. 6B is a top perspective view, partially cut away, of a portion of a lid according to a second exemplary embodiment of the present invention. As an alternative to the drink inlets 13 depicted in FIG. 6A, the drink inlets 13' may be located along the lower wall portion 12 such that a small lip 'y' remains between the lowermost portion 14D of the reservoir 6, and the lower side of the drink inlets 13.

Although the drink inlets 13 depicted in FIGS. 6A and 6B are shown to be elliptical with centermost point located along line 'S,' and vertically oriented, the general shape of the drink inlets may vary without departing from the scope of the present invention. For example, the drink inlets 13 may be circular, polygonal, elliptical, orthogonal and the like. The orientation of the drink inlets 13 may also be changed from what is depicted in FIGS. 6A and 6B. For example, the orientation of the drink inlets 13 may be reversed so that the vertical axis becomes the major axis, and the horizontal axis, becomes the minor axis. In one exemplary embodiment, the drink inlets 13 may include a major horizontal axis of 7 mm and a minor vertical axis of 5 mm. The drink inlets 13 depicted in FIGS. 6A and 6B may be manufactured by puncturing through the surface of the lower wall portion 12. Each of the drink inlets 13 may have an opening area in the range between 10 $mm^2$ and 50 $mm^2$, but preferably about 30 $mm^2$. As will be discussed below, the drink inlets 13 of the lid 1 provide the user with both protection from spillage of the beverage, and a natural drinking experience.

Figure 7A:
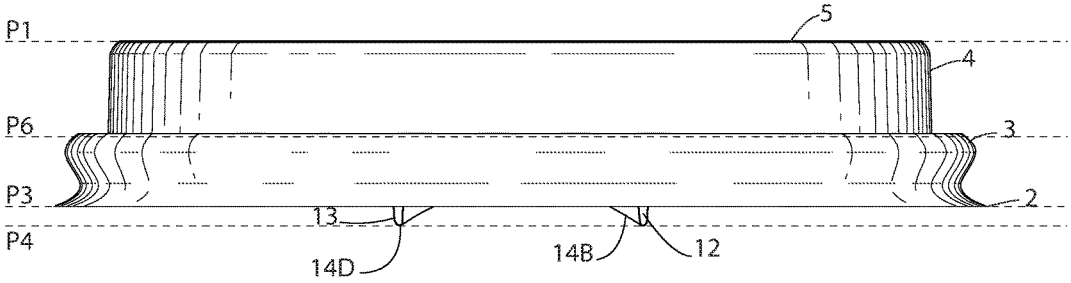
FIG. 7A is a front side view of the lid shown in FIG. 1.
Figure 7B:
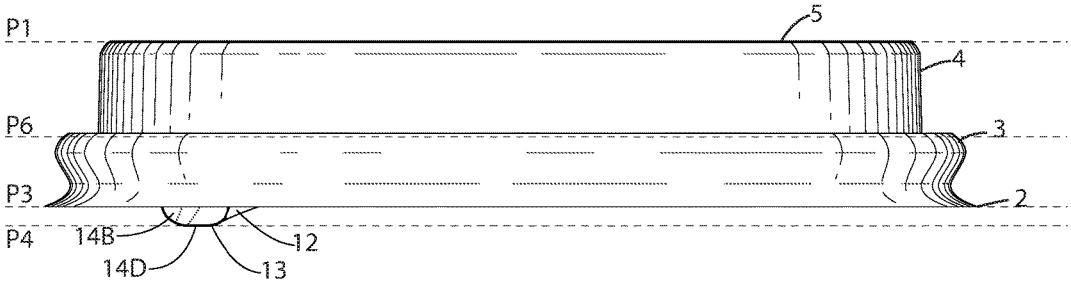
FIG. 7B is a lateral side view of the lid shown in FIG. 1.

FIG. 7A is a front side view of a lid according to a first exemplary embodiment of the present invention. The front side view of FIG. 7A is taken from the front (where a user would be positioned in order to drink from the lid 1 and container 50). FIG. 7B is a lateral side view of a lid according to a first exemplary embodiment of the present invention. As depicted in FIGS. 7A and 7B, at least a portion of the reservoir 6 terminates below the circular base 2 of the lid 1.

Figure 8:
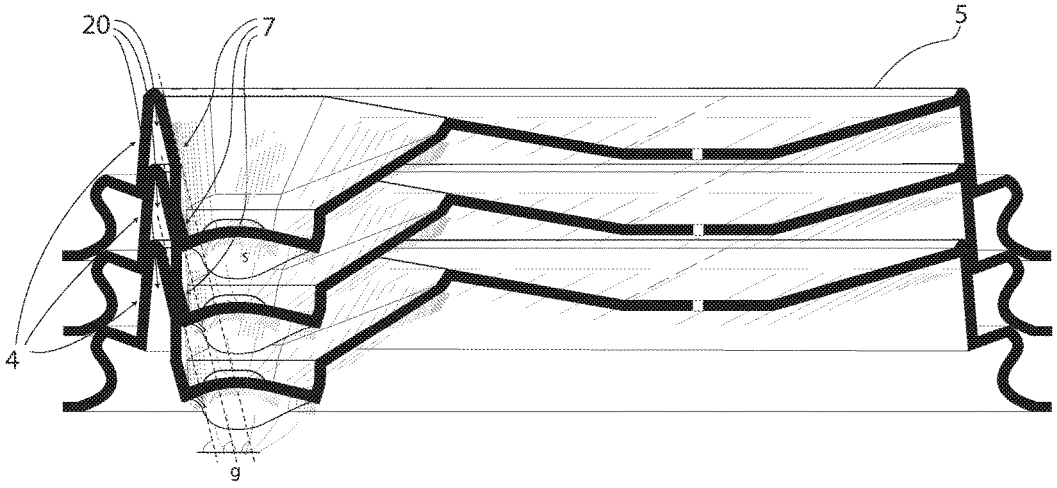
FIG. 8 is a side view of multiple lids according to a first exemplary embodiment of the present invention, in a stacked configuration.

FIG. 8 is a side cross-sectional view of multiple lids 1 according to a first exemplary embodiment of the present invention, in a stacked configuration. The cross-section shown here is taken along centerline c1 in FIG. 2. As depicted, each of the lids 1 may have a back wall 7 which is disposed at an angle 'g' with respect to horizontal planes p1, p2, p3 and p4, and a corresponding hollow lip 20 (discussed above in relation to FIG. 4) that may be configured such that multiple lids may be vertically stacked. The configuration shown in FIG. 8 may be used when the lids are packaged for distribution.

The various embodiments of the lid 1 described above may be manufactured as a single piece. Alternatively, the lid 1 may be manufactured as multiple pieces. The lid 1 may be manufactured by at least one of thermoforming, injection molding, compression molding, vacuum forming, pressure forming and hydroforming. The lid 1 may be disposable and/or recyclable. Additionally, the lid 1 may be made of plastic, or any other suitable material.

While the general structure of the lid 1 has been described above in relation to FIGS. 1-8, the following sections provide additional information related to the dimensions and configurations of the lid 1 which provide the user with both protection from spillage of the beverage, and a natural drinking experience.

As described above, the lid 1 may be disposed in a drinking position and a non-drinking position (as shown in FIG. 3). In the drinking position, the lid 1 may be configured to engage with the upper edge p6 of the container 50. The lid 1 may then be tilted such that the one or more liquids in the container 50 pass through the one or more inlets 13 to fill at least a portion of the reservoir 6 with the one or more liquids. As will be understood by those of ordinary skill in the art, a user may drink from the container 50 via the lid 1 when the lid is in a drinking position.

In a non-drinking position, the lid 1 and the upper edge p6 of the container 50 may also be engaged. The upper wall portion 10 and the lower wall portion 12 of the reservoir 6 may be configured to remove the one or more liquids from the lid 1 in the non-drinking position. Specifically, the upper and lower wall portions 10, 12 are slanted downwardly towards the one or more inlets 13, so that when the container is placed down on a flat surface, the one or more liquids in the reservoir 6 will drain out of the reservoir, and back into the container 50. Additionally, the lower level 14 of the lid 1 may also aid in draining the one or more liquids out of the reservoir 6 and into the container 50. In particular, the surrounding areas 14B of the lower level 14 may slant towards the one or more inlets 13 so that the liquid may pass through the one or more inlets 13 into the container 50.

The lid 1 may be configured to provide a user with protection from spillage of a beverage contained within the container 50. For example, the beverage may be coffee, and the lid 1 may prevent spillage of the coffee during movement of the user. Protection from spillage of the beverage is achieved in part due to the configuration of the one or more inlets 13. As discussed above, the one or more inlets 13 may be located along the lower wall portion 12 of the reservoir 6. The one or more inlets 13 may be placed below the third plane p3 shown in FIG. 3. However, it is advisable that the one or more inlets 13 are not placed too far below the third plane p3, so as to avoid any undesired submerging when the lid 1 and the container 50 are not in a drinking position. In other words, the one or more inlets 13 should not be placed so low that the beverage in the container 50 flows through them when the container is in a non-drinking position, and is filled to the top with a beverage. In one embodiment, the third plane p3 is located approximately about 14.5 mm from the top surface 15 of the lid. The distance of the third plane p3 from the top surface 15 may vary in accordance of the length of the side wall 4. In another embodiment, the lower half of each of the one or more inlets 13 may be located below the upper edge p6 of the container.

In the exemplary embodiments described herein, the lid 1 includes two drink inlets 13 located along the lower wall portion 12 of the reservoir 6, which are symmetrical about a centerline c1. These drink inlets 13 are oriented such that the direct vertical path provided for the liquid to escape to the container 50 is minimized. For example, as depicted in FIGS. 1-8, the drink inlets 13 may be vertically oriented with angle 'b' along the minor vertical axis being about ninety degrees (90°). Alternatively, as shown in FIG. 5, angle 'b' may be any angle in the range of about forty-five degrees (45°) to ninety degrees (90°). The angle 'b' may depend upon the manufacturing method used for the lid 1. When the angle 'b' is between forty-five degrees (45°) and ninety degrees (90°) the one or more inlets may be manufactured using standard cutting techniques. The closer the angle 'b' is to 90 degrees (90°), the smaller the direct path the liquid has towards the outside of the container 50, and accordingly the better splash resistance the lid 1 will have. In the exemplary embodiments of the lid 1 described herein, any liquid which vertically sloshes from the container 50 will be met by the bottom surface of the lower level 14 and have no direct path to escape. Alternatively, the angle 'b' may be configured to be greater than ninety degrees (90°). In such an embodiment the one or more inlets may be manufactured by being stamped out or cut out from undercuts formed in the plastic lid 1.

When the container 50 and lid 1 are in use one of the most prevalent axes for liquid sloshing is along the centerline c1 (back and forth sloshing). To further maximize splash resistance, the one or more drink inlets 13 may be oriented substantially parallel to centerline c1. For example, in the exemplary embodiment(s) of the invention, each of the drink inlets 13 form an angle 'a' with respect to the centerline c1. As shown in FIG. 2, this angle may be relatively small, in a range from 5 degrees (5°) to 15 degrees (15°), but preferable about 7 degrees (7°). Angle 'a' may be any suitable angle such that the passing of liquids through the one or more inlets due to back and forth sloshing is minimized. In the exemplary embodiments, back and forth sloshing of the liquid in the container 50 will cause the liquid to either hit the bottom side of the lower level 14, or ride up the inner walls 40 of the container 50 into the hollow lip 20 to be stopped by the bottom side of the peripheral lip 5, thereby missing the one or more drink inlets 13.

Rotational sloshing may lead to the liquid in the container 50 sloshing around the periphery of the inner walls 40 (see FIG. 3). To mitigate rotational sloshing, the drink inlets 13 may be positioned far enough toward the center 'C' of the lid 1 so that there is enough room for the liquid to pass through the hollow lip 20, thereby missing the drink inlets 13.

Accordingly, the overall contact between the sloshing of the liquid in the container 50 and the drink inlets 13 is minimized in both back and forth, and rotational, sloshing, thereby providing a user with protection from spillage of the liquid.

The distance between the one or more drink inlets 13 may be optimized to provide additional splash resistance. For example if the drink inlets 13 are located too close to each other, on the order of about 5 mm, there may be manufacturing complications which may also negatively impact the splash resistance properties of the lid 1.

In one exemplary embodiment, the centermost point of a drink inlet 13 may be positioned along line 'S' located a distance d4 from the tangent line T1 that marks the outermost edge of the rim 3 (see FIG. 4). In the depicted embodiments, the distance d4 may be in the range between about 8 mm and 25 mm, and more particularly 13 mm. The distance d4 may be correlated with splash resistance and inversely correlated with providing a natural drinking experience. For example, while a larger distance for d4 may provide improved splash resistance and it may also reduce the flow of liquid to the reservoir 6, thereby providing a reduced natural drinking experience.

In the case that a portion of the liquid in the container 50 passes through one of the drink inlets 13 into the reservoir 6 due to rotational sloshing, the liquid typically drains directly out of an opposing inlet.

The first volume portion v1 of the reservoir 6 also provides splash resistance to the user. More particularly, the first volume portion v1 may be configured to catch the residual splashing of any liquids that escape through the drink inlets 13 at an angle. For example, if due to rotational sloshing some liquid manages to splash out of one of the inlets 13 at a diagonal angle, it will encounter the upper wall 10 of the first volume portion v1. After having been stopped by upper wall 10, the liquid will then be drained down the radially inwardly sloped upper level 11 from which it will be further directed to the lower level 14 and onto the lower raised central base 14A from which it will finally be drained back down via the slanted surrounding areas 14B into the container 50 through the one or more drink inlets 13.

Although, any suitable dimensions, angles, and slopes for preventing splashing may be used, configurations for the depicted exemplary embodiments are discussed. In an exemplary embodiment, the upper wall 10 may have a vertical height of about 8 mm and an average width of about 9 mm. The upper wall 10 may be larger than the one or more drink inlets 13. In an embodiment of the device having an upper wall 10 comprising one or more sub-portions, each of the upper wall sub-portions may have varied vertical height. In such an embodiment, the upper wall sub-portions located opposite of each of the one or more inlets may have a greater height than the other sub-portions so as to minimize rotational splashing of the liquid. In order to prevent diagonal splashing of the liquid, the upper wall 10 (or upper wall sub-portions) may recede at almost a vertical angle 'm.' As illustrated in FIG. 5, the angle 'm' may be in the range between approximately fifty degrees (50°) to ninety degrees (90°). In one embodiment, the vertical angle 'm' may be about seventy-five degrees (75°). The receding upper wall 10 may slope radially inwards towards the upper level 11 at an angle of about five degrees (5°). The upper level may connect to a lower wall 12 which recedes from the upper level 11 radially inwards towards the lower level 14 at about a ninety degree (90°) angle 'b' to connect with the lower level 14.

The convex shape of the lower level 14 may help to drain the liquid from the reservoir 6 when the container 50 and lid 1 are not in a drinking position. As discussed above, in one embodiment the lower level 14 may have a lower raised central base 14A with a high point at the fifth plane p5 (see FIG. 4). The lower raised central base 14A may be located midway between two drink inlets 13, or halfway across distance d3. The slanted surrounding areas 14B may be configured to extend from the lower raised central base 14A to the one or more inlets 13. In one exemplary embodiment the slanted surrounding areas 14B may be slanted by about twenty-five degrees (25°). Alternatively, the slope of the surrounding area 14B may be any degree greater than five degrees (5°) in order to provide successful drainage. The lower level 14 may be configured such that when the container 50 and lid 1 are tilted back towards a non-drinking position, the liquid in the container travels from the lower raised central base 14A towards the one or more inlets 13, and through the one or more inlets 13 into the container 50.

The lid 1 may also be configured to provide the user with a natural drinking experience. For example, a natural drinking experience may be similar to drinking a liquid from a coffee mug. To that end, the first volume portion v1 of the reservoir 6 may have the initial opening width d1 suitable for accommodating the human mouth. The initial opening width d1 may be measured along the top surface of the reservoir 6. In an exemplary embodiment, the reservoir 6 may have a total vertical depth 'V' of about 16 mm measured from the first plane p1 to the fourth plane p4. The total vertical depth V of the reservoir 6 is important for delivering a sufficient volume of the liquid in the container 50 for a natural drinking experience. For example, the total vertical depth V may range between about 8 mm and 25 mm, as long as d1 and d2 allow for a reservoir 6 with a total volume of at least 2,000 $mm^3$ when the container 50 and lid 1 are tilted in direction R at about 75 degrees (i.e., the drinking position). The reservoir 6 may also include a vertical distance v3 configured so that the user's lips do not touch the lower level 14. In an exemplary embodiment, the vertical distance v3 may be about 8 mm to 15 mm. More particularly, the vertical distance v3 may be about 12 mm. A larger vertical distance v3 may provide a greater volume for the reservoir so as to provide a greater volume for a sufficient sip. The reservoir 6 may have a total volume of around 4,000 $mm^3$ when the container 50 is tilted at approximately seventy-five degrees (75°) (i.e., into the drinking position). Alternatively, the total volume of liquid may be in the range of between about 2,000 $mm^3$-5,000 $mm^3$. The total depth V of the reservoir 6 also plays a role in providing an uninterrupted drinking experience. With a larger total depth V the liquid is given more time to fill the reservoir 6 from the second volume portion v2 to the uppermost opening where the user will generally receive the drink. A larger total depth V will ensure that the user receives the drink with no interruptions or delay.

For the lid 1 to ensure a successful natural drinking experience it must provide a smooth and uninterrupted flow of liquid from the container 50 to the reservoir 6 when the container 50 and lid 1 are tilted for use. The flow should be fast enough to fill the reservoir 6 so that the user receives the drink immediately and is not delayed. To insure good flow an exemplary embodiment of the invention has one or more drink inlets 13 placed deep within the reservoir 6 at a fourth plane p4 located approximately about 3-5 mm under the third plane p3. The closer the drink inlets 13 are from the horizontal level q1 of the liquid when the container 50 and lid 1 are in a non-drinking position, the quicker the drink inlets 13 submerge into the liquid, allowing the liquid to fill the reservoir 6 when the lid 1 and container 50 are tilted for use.

In one exemplary embodiment, the first volume portion v1 and the second volume portion v2 may provide a total depth V of about 16 mm. In such an embodiment, the ratio of the first volume portion v1 to the second volume portion v2 may be about 6:4. The ratio of the first volume portion v1 to the second volume portion v2 may be adjusted. For example, if larger drink inlets 13 are required for better flow (and a more natural drinking experience) the ratio may shift to 4:6 to favor the second volume portion v2 giving lower wall 12 more vertical length to accommodate larger drink inlets 13. However, doing so may negatively affect the splash resistant properties of the lid 1 by providing more room for the liquid to escape the containment and minimizing the length of upper wall 10 which is configured to catch any residual liquid that that manages to escape.

In one embodiment having two drink inlets 13, the drink inlets may be separated by a distance d3 of about 20 mm. In one exemplary embodiment d3 may be about half of d1. The two drink inlets 13 may be positioned symmetrically about the centerline c1 at about a distance of 10 mm from the centerline c1. The closer each of the drink inlets 13 are to centerline c1 the less rotation/tilt is required from the user's end to start the process of filling the reservoir 6, since the drink inlets 13 will be vertically closer to the surface of the liquid when the container is being tilted for use. In other embodiments the ratio of d1 to d3 may range between 10:7 to 10:2.

In an exemplary embodiment, the stepped structure of the reservoir 6 provides for a successful natural drinking experience. The first volume v1 of the reservoir 6 with initial width d1 accommodates the average human mouth and provide space for a larger liquid volume, while the lower volume v2 is made narrower so to bring the one or more drink inlets 13 closer to centerline c1 for better and more immediate flow.

In view of the foregoing detailed description of exemplary embodiments of the present invention, it readily will be understood by those persons skilled in the art that the present invention is susceptible to broad utility and application. While various aspects have been described in the context of standalone application, the aspects may be useful in other contexts as well. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Furthermore, any sequence(s) and/or temporal order of steps of various processes described and claimed herein are those considered to be the best mode contemplated for carrying out the present invention. It should also be understood that, although steps of various processes may be shown and described as being in an exemplary sequence or temporal order, the steps of any such processes are not limited to being carried out in any particular sequence or order, absent a specific indication of such to achieve a particular intended result. In most cases, the steps of such processes may be carried out in various different sequences and orders, while still falling within the scope of the present inventions. In addition, some steps may be carried out simultaneously. Accordingly, while the present invention has been described herein in detail in relation to exemplary embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention. This disclosure is intended to cover any adaptations or variations of the embodiments discussed herein.

What is claimed is:

1. A lid for covering a container containing one or more liquids, the lid comprising:

a top surface; and a reservoir formed below the top surface, the reservoir including an upper level and a lower level and further comprising:

an upper wall portion extending from the top surface to the upper level of the reservoir, wherein the upper wall portion is slanted radially inwards;

a lower wall portion extending from the upper level to the lower level of the reservoir, wherein the lower wall portion is slanted radially inwards and comprises one or more inlets, each of the one or more inlets being configured to allow the one or more liquids from the container to pass therethrough when the container is in a drinking position, and onto at least the lower level of the reservoir;

wherein the lower level of the reservoir is convex with a raised central base and one or more surrounding areas, wherein in the drinking position the one or more liquids in the container pass through the one or more inlets to fill at least a portion of the reservoir, and wherein at least one of the upper wall portion, the lower wall portion, the upper level, and the lower level are configured to drain the one or more liquids from the reservoir when the container is not in a drinking position, by allowing the one or more liquids to flow towards the container through the one or more inlets.

2. The lid of claim 1, wherein the top surface further comprises one or more air inlets configured to allow air flow.

3. The lid of claim 1, wherein the top surface further comprises one or more indented regions configured to receive one or more body parts of the user.

4. The lid of claim 1, wherein the lid is manufactured as a single piece.

5. The lid of claim 4, wherein the lid is manufactured by one of thermoforming, injection molding, compression molding, vacuum forming, pressure forming or hydroforming.

6. The lid of claim 1, wherein the reservoir is substantially u-shaped.

7. The lid of claim 1, wherein each of the surrounding areas slants towards a respective one of the one or more inlets, thereby allowing the one or more liquids to flow downwards towards the container through the one or more inlets when the container is not in a drinking position.

8. The lid of claim 7, wherein each of the surrounding areas slants at an angle of at least five degrees.

9. The lid of claim 1, wherein the one or more inlets are disposed on one or more axes, the one or more axes forming an angle between about zero and fifteen degrees with respect to a direction of tilting of the container.

10. The lid of claim 1, wherein the lid is stackable.

11. The lid of claim 1, wherein the one or more inlets on the lower wall are positioned adjacent to the lower level of the reservoir.

12. The lid of claim 1, wherein the one or more inlets are at least one of circular, polygonal, and elliptical in shape.

13. The lid of claim 1, wherein each of the one or more inlets are of an area of about 10 $mm^2$-50 $mm^2$.

14. The lid of claim 1, wherein the reservoir provides a volume of about 2,000 $mm^3$-5,000 $mm^3$.

15. The lid of claim 1, wherein a width of the lower level of the reservoir is smaller than a width of the upper level of the reservoir.

16. The lid of claim 1, wherein the upper wall portion of the reservoir is slanted radially inwards at an angle between about fifty-five degrees to eighty-five degrees.

17. The lid of claim 1, wherein the lower wall portion of the reservoir is slanted radially inwards at an angle between about seventy degrees to ninety degrees.

18. The lid of claim 1, further comprising:

a rim around the periphery of the lid, the rim comprising a first wall and a second wall, the rim configured to engage an upper edge of the container between the first wall and the second wall.

19. The lid of claim 18, wherein at least a portion of the lower level of the reservoir is positioned below an upper edge of the container.

20. The lid of claim 15, wherein a width of an initial opening of the reservoir is about 40% to 70% of the diameter of the lid.

21. The lid of claim 1, wherein a width of the lower level of the reservoir is about 5% to 40% of the diameter of the lid.

22. The lid of claim 1, wherein a length of the reservoir is between about 12.5% to 75% of the diameter of the lid.

23. The lid of claim 1, wherein a height of the reservoir is between about 8 mm to 20 mm.

24. The lid of claim 1, wherein at least one of the lower wall portion, the upper level, the upper wall portion comprises one or more sub-portions, each of the sub-portions slanting radially inwards at varied angles.

25. The lid of claim 1, wherein the reservoir is substantially rectangular shaped.

26. The lid of claim 19, wherein a lowest portion of the lower level of the reservoir is positioned about 3 mm to 15 mm below the upper edge of the container.

27. The lid of claim 19, wherein at least one of the one or more inlets is positioned at least partially below the upper edge of the container.

* * * * *